United States Patent [19]

Lambin

[11] 3,989,092

[45] Nov. 2, 1976

[54] INSTALLATION FOR THE CONTINUOUS CASTING OF A METAL STRAND

[75] Inventor: Andre Lambin, Marcq-en-Baroeul, France

[73] Assignee: Fives-Cail Babcock, Paris, France

[22] Filed: Feb. 6, 1976

[21] Appl. No.: 655,823

[52] U.S. Cl. ..... 164/260; 164/282

[51] Int. Cl.[2] ..... B22D 11/14

[58] Field of Search ..... 164/260, 282, 283 S

[56] References Cited

UNITED STATES PATENTS

| | | | |
|---|---|---|---|
| 3,627,026 | 12/1971 | Bohne et al. | 164/282 |
| 3,779,303 | 12/1973 | Pietryka | 164/282 |

*Primary Examiner*—Robert D. Baldwin

*Attorney, Agent, or Firm*—Kurt Kelman

[57] ABSTRACT

In a continuous casting installation, a casing wherein a primary roller apron section is mounted for guiding the cast metal strand is mounted on a framework for displacement in a direction transverse to the axis along which molten metal is cast from an ingot mold to form the strand. A curvilinear secondary roller apron section is axially aligned with the primary apron section and includes a support for the rollers of this section for further guiding the cast metal strand. The two sections are coupled together between an upper part of the secondary apron section support and an element of the casing in such a manner as to provide self-alignment of the two apron sections upon a relative displacement between the casing and the secondary roller apron section.

10 Claims, 3 Drawing Figures

INSTALLATION FOR THE CONTINUOUS CASTING OF A METAL STRAND

The present invention relates to improvements in an installation for the continuous casting of a metal strand.

Conventional casting installations comprise an ingot mold having an axis along which the molten metal is cast to form the strand, means for oscillating the mold in the direction of the axis, a casing disposed below the mold and surrounding the cast metal strand, a framework supporting the casing, a primary roller apron section mounted in the casing for guiding the cast metal strand, and a curvilinear secondary roller apron section axially aligned with the primary apron section. The secondary apron section includes a support for the rollers of this section for further guiding the cast metal strand in a curvilinear transition path between the vertical and the horizontal. The casing is constituted by a double-walled frame which is open on top and bottom to permit the freshly cast metal strand being guided by the rollers of the primary roller apron section to pass vertically therethrough while being cooled.

It is known that it is essential for the good quality of the ingot produced in such a casting installation to keep the two apron sections in accurate axial alignment, regardless of any deformations to which the operating stresses subject the installation, the most damaging deformations being those produced in a direction transverse to the secondary roller apron section.

In a conventional installation of the indicated type, self-alignment of the two apron sections is obtained by affixing the casing wherein the primary apron section is mounted to the upper part of the secondary apron section.

Such an arrangement may be difficult in installations where the secondary roller apron section comprises successive segments each carrying several pairs of guide rollers mounted separately on the support for the secondary apron section. Such a support is necessarily less rigid and, consequently, tends more readily to be deformed. It is, therefore, risky to support the casing on the upper part of the secondary apron section in an effort to keep the two sections in alignment.

It has also been proposed to mount the casing on a framework independent from the support of the secondary roller apron section but experience has proved that self-alignment of the two apron sections cannot be accomplished in this manner because the deformations of the framework and of the support are not coordinated.

It is the primary object of this invention to overcome these disadvantages and to provide an improved arrangement for the self-alignment of the two guide sections of a continuous casting installation.

The above and other objects are accomplished in accordance with the invention by coupling means connecting the two roller apron sections and arranged between an upper part of the secondary roller apron section support and an element of the casing, the coupling means being constructed to provide self-alignment of the two apron sections upon a relative displacement between the casing and the secondary roller apron section, and means mounting the casing on the framework for displacement in a direction transverse to the axis along which molten metal is cast to form a metal strand.

The above and other objects, advantages and features of the present invention will become more apparent from the following detailed description of two now preferred embodiments thereof, taken in conjunction with the accompanying drawing wherein FIG. 1 is a partial and schematic side elevational view of one embodiment of a casting installation incorporating the structural features of this invention;

Figure 1:
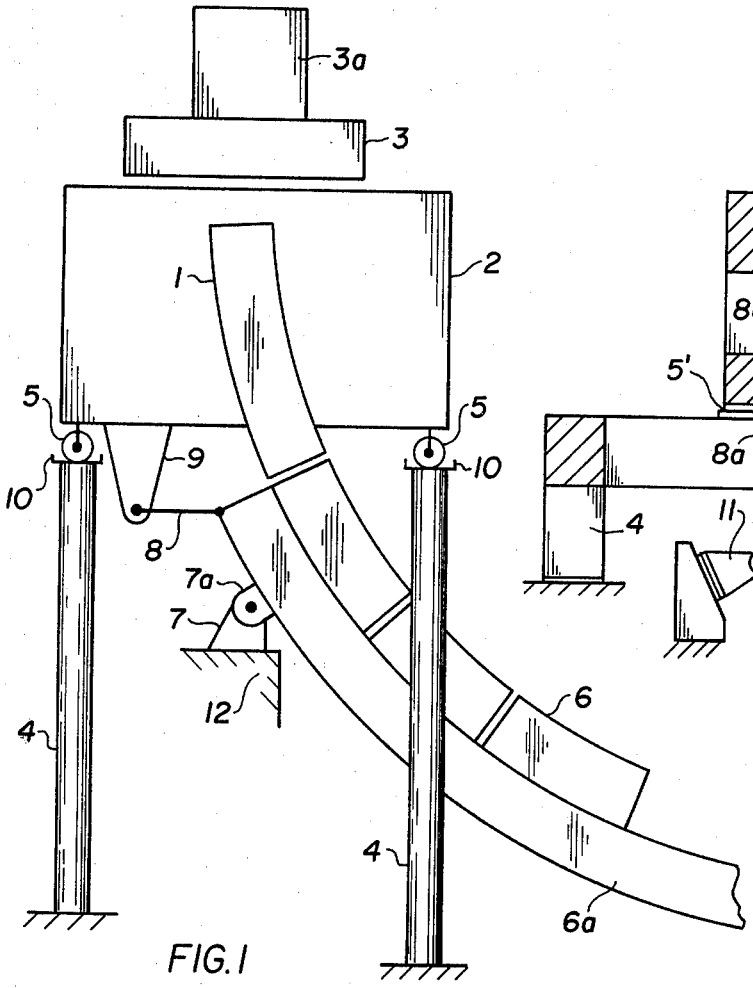

Referring now to the drawing and first to FIG. 1, there is shown an installation for the continuous casting of a metal strand, which comprises ingot mold 3*a* having a vertical axis along which molten metal is cast to form the strand. As in conventional and only schematically indicated, the mold is mounted on oscillating table 3 for oscillating the mold in the direction of the axis. This permits perfect selfalignment of the ingot mold with primary roller apron section 1. This section is conventional and carries a series of guide rollers wherebetween the freshly cast metal strand is guided away and downwardly from the ingot mold. This apron section is mounted in casing 2 which is disposed below mold 3*a* and surrounds the cast metal strand. The casing is constituted by a double-walled frame or jacket of rectangular shape, open on top and bottom, and having a vertical axis along which the primary apron section extends. The jacket is cooled by water in a known manner so as to cool the freshly cast metal strand as it is being guided by the rollers of section 1.

A framework consisting of posts 4 supports casing 2, rollers 5 mounting the casing on top of the posts for displacement in a direction transverse to the casting axis. Abutments 10 are provided on top of the posts to limit the axial displacement of casing 2.

A curvilinear secondary roller apron section 6 is axially aligned with primary apron section 1 and includes curvilinear support 6*a* for the rollers of this section for further guiding the cast metal strand. The secondary apron section rests on foundation 12, brace 7*a* pivotally mounting this apron section on base 7 which is supported on the foundation. According to the invention, apron sections 1 and 6 are connected by coupling means arranged between the upper part of secondary roller apron section support 6*a* and an element of casing 2, the coupling means being constructed to provide self-alignment of the two apron sections upon a relative displacement between casing 2 and secondary roller apron section 6.

The coupling means in the embodiment of FIG. 1 is a coupling rod 8 pivoted respectively to the upper part of support 6*a* and brace 9 affixed to casing 2 and depending from its lower end. The level of the pivot of coupling rod 8 on brace 9 is so positioned as to permit displacement of rod 8 substantially in a horizontal direction, thus forcing a correlated displacement of casing 2 on rollers 5 in the same direction. This correlated displacement assures accurate alignment of the two apron sections at all times. This level of the pivot is preferably such that coupling rod 8 may be oriented between the illustrated first position wherein it extends substantially parallel to the direction of displacement of casing 2, i.e. horizontally, and a second position wherein it extends substantially parallel to the direction of the radius of curvature of the secondary apron section at that level.

Figure 2:
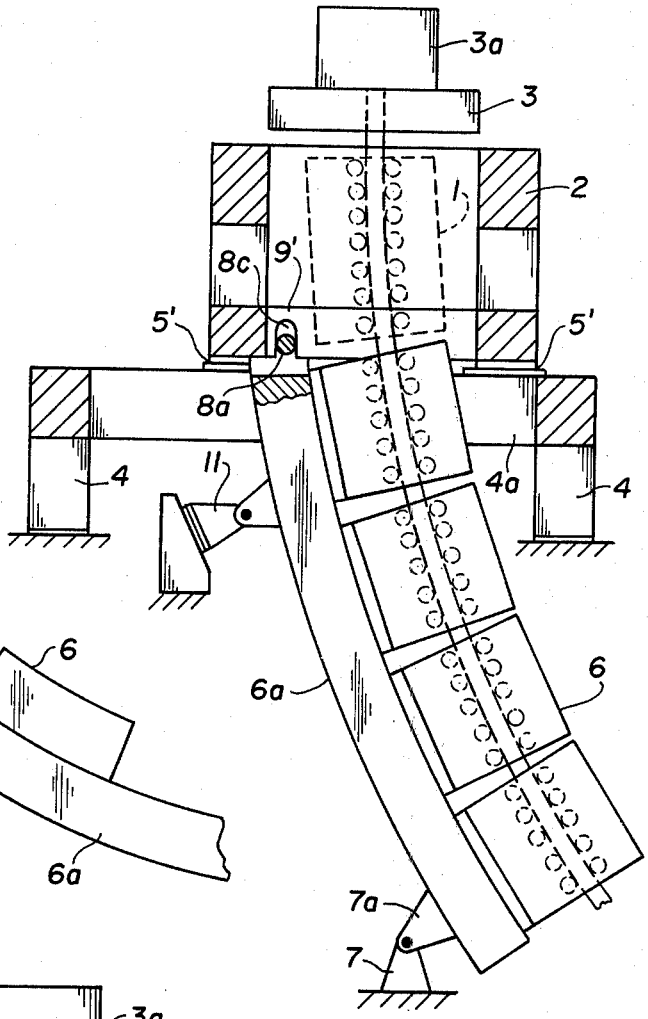
FIG. 2 is a similar view of another embodiment.
Figure 3:
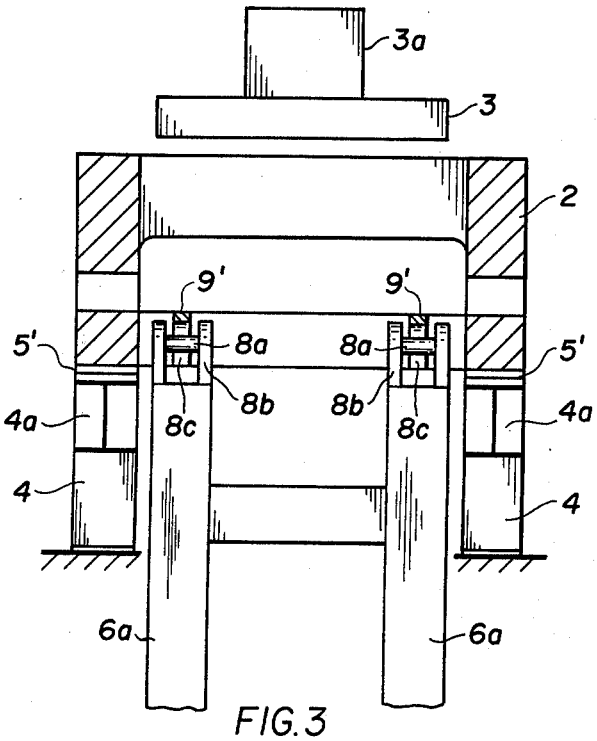
FIG. 3 is an end elevational view, partly in section, illustrating the coupling and displacement means used in the embodiment of FIG. 2.

In the embodiment of FIGS. 2 and 3, the same reference numerals designate like parts functioning in a like manner as in the similar installation of FIG. 1. However, in this embodiment, the pivotal support 7, 7*a* for apron section 6 on foundation 12 is arranged at the lower end of this apron section and an auxiliary gliding pivotal support 11 mounts the upper part of section 6 on the foundation. Furthermore, rollers 5 are replaced by sliding blocks 5', 5' for displacement of casing 2 on crossbeams 4*a* of the support framework. Obviously, any suitable anti-friction elements may be used to mount the casing on the framework for transverse displacement.

As best shown in FIG. 3, the support of the secondary roller apron section 6 comprises two trusses 6*a* each of which has affixed to the upper end thereof a two-armed bearing fork 8*b* bridged by stub shaft 8*a* mounted on the arms of the bearing fork. Each shaft 8*a* is engaged in cooperating slot 8*c* which is in stationary relationship to apron section 1. In the illustrated embodiment, the slot is defined in crossbeam 9' of casing 2. Each slot 8*c* receiving a respective shaft 8*a* is constituted by a vertical or substantially vertical groove whose walls guide the vertical displacement of the shafts, the horizontal displacement thereof forcing a correlated displacement of casing 2 on sliding blocks 5'. These two displacements result from the deformations of apron section 6 due to expansion thereof caused by heat, and they correspond to the vertical and horizontal components of the forces acting on the apron section. As in the embodiment of FIG. 1, the illustrated coupling means assures the self-alignment of the two apron sections. The advantage of the last-described coupling arrangement over that of FIG. 1 resides in the fact that it does not fixedly interconnect apron sections 1 and 6, which makes it easier to disassemble the installation.

In the case of the embodiment of FIG. 1, one or more coupling rods 8 may pivotally connect the upper part of apron section 6 to one or more braces 9, any suitable element being useful for connection to casing 2 and any suitable connecting member being usable instead of rod 8, such as flexible blades.

In the embodiment of FIGS. 2 and 3, the bearing fork 8*b* with shaft 8*a* may be affixed to crossbeam 9' and slot 8*c* may be provided in support 6*a*, i.e. the arrangement may be reversed without changing the operation. Also several such cooperating coupling arrangements may be provided.

Generally, various changes and modification of specific structures will readily occur to those skilled in the art, particularly after benefiting from the present teaching, without departing from the spirit and scope of this invention as defined in the appended claims.

I claim:

1. In an installation for the continuous casting of a metal strand, which comprises an ingot mold having an axis along which molten metal is cast to form the strand, means for oscillating the mold in the direction of the axis, a casing disposed below the mold and surrounding the cast metal strand, a framework supporting the casing, a primary roller apron section mounted in the casing for guiding the cast metal strand, and a curvilinear secondary roller apron section axially aligned with the primary apron section, the secondary apron section including a pivotally-mounted support for the rollers of said secondary apron section for further guiding the cast metal strand, the improvement comprising 1. coupling means non-ridgedly indirectly connecting the two roller apron sections, the coupling means being arranged between an upper part of the secondary apron section support and an element of the casing, the coupling means being constructed to provide self-alignment of the two apron sections upon a relative displacement between the casing and the secondary roller apron section, and
2. means mounting the casing on the framework for free displacement in a direction transverse to the axis.

2. In the casting installation of claim 1, the coupling means being constituted by a connecting member pivoted respectively to the upper part of the secondary apron section support and the casing element.

3. In the casting installation of claim 2, the pivot of the connecting member to the casing element being positioned at a level permitting the connecting member to be oriented between a first position wherein it extends substantially parallel to the direction of displacement of the casing and a second position wherein it extends substantially parallel to the direction of the radius of curvature of the secondary roller apron section at said level.

4. In the casting installation of claim 1, the coupling means being constituted by at least one coupling rod.

5. In the casting installation of claim 1, the coupling means being constituted by at least one brace.

6. In the casting installation of claim 1, the coupling means including a two-armed bearing fork affixed to one of the apron sections, a stub shaft mounted on the two arms of the bearing fork and bridging the bearing fork, and a cooperating slot in stationary relationship to the other apron section, the shaft being engaged in the slot.

7. In the casting installation of claim 6, the bearing fork being affixed to the secondary roller apron section and the slot being defined in the casing wherein the primary roller apron section is mounted.

8. In the casting installation of claim 7, the casing including a crossbeam wherein the slot is defined.

9. In the casting installation of claim 1, the means mounting the casing for displacement being rollers.

10. In the casting installation of claim 1, the means mounting the casing for displacement being sliding blocks.

* * * * *